US012180732B2

(12) United States Patent
Johnson et al.

(10) Patent No.: US 12,180,732 B2
(45) Date of Patent: Dec. 31, 2024

(54) MODULAR FOUNDATION FOR TOWER WITH EXPANDABLE BASE

(71) Applicant: ARE Telecom Incorporated, St. Paul, MN (US)

(72) Inventors: Dion Johnson, St. Paul, MN (US); Michael Clifton, Flagstaff, AZ (US)

(73) Assignee: ARE Telecom Incorporated, St. Paul, MN (US)

( * ) Notice: Subject to any disclaimer, the term of this patent is extended or adjusted under 35 U.S.C. 154(b) by 0 days.

(21) Appl. No.: 18/161,703

(22) Filed: Jan. 30, 2023

(65) Prior Publication Data

US 2023/0243176 A1 Aug. 3, 2023

Related U.S. Application Data

(60) Provisional application No. 63/304,791, filed on Jan. 31, 2022.

(51) Int. Cl.
*E04H 12/22* (2006.01)
*E04H 12/34* (2006.01)
*E04H 12/10* (2006.01)

(52) U.S. Cl.
CPC ..... *E04H 12/2246* (2013.01); *E04H 12/345* (2013.01); *E04H 12/10* (2013.01)

(58) Field of Classification Search
CPC ... E04H 12/18; E04H 12/2246; E04H 12/345; E04H 12/10
USPC ..... 248/519
See application file for complete search history.

(56) References Cited

U.S. PATENT DOCUMENTS

| | | | | |
|---|---|---|---|---|
| 7,246,782 | B2 | 7/2007 | Crookham et al. | |
| 8,960,615 | B1 * | 2/2015 | Johnson | F03D 13/22 248/431 |
| 8,969,615 | B2 * | 3/2015 | Lehr | C07C 263/10 560/347 |
| 9,328,861 | B2 * | 5/2016 | Johnson | F16M 11/22 |
| 10,107,003 | B1 | 10/2018 | Harmer | |
| 10,422,100 | B2 | 9/2019 | Shi et al. | |
| 10,634,122 | B1 * | 4/2020 | Clifton | E04H 12/345 |
| 11,053,923 | B2 * | 7/2021 | Clifton | H02S 10/12 |
| 2012/0228442 | A1 | 9/2012 | Clifton | |

FOREIGN PATENT DOCUMENTS

| | | | |
|---|---|---|---|
| AU | 2014265049 | B1 | 11/2014 |
| FR | 2964133 | B1 | 3/2012 |

* cited by examiner

*Primary Examiner* — Todd M Epps
(74) *Attorney, Agent, or Firm* — Westman, Champlin & Koehler, P.A.

(57) ABSTRACT

A foundation for a tower includes a plurality of ballast holders spaced from each other and a central portion configured to support a tower. The foundation includes a plurality of connecting members, each connecting member configured to attach a ballast holder to the central portion, wherein a length of the plurality of connecting members is determined based upon the load capacity required to retain the tower in a vertical position, wherein when the plurality of ballast holders is connected to the central portion, the central portion is elevated above the plurality of ballast holders, wherein different lengths of the connecting members expands and contracts the footprint of the foundation to match the foundation to the required maximum loading requirements.

20 Claims, 7 Drawing Sheets

MODULAR FOUNDATION FOR TOWER WITH EXPANDABLE BASE

CROSS REFERENCE TO RELATED APPLICATION(S)

The present application claims the benefit of U.S. Provisional Patent Application Serial No. 63/304,791 entitled MODULAR FOUNDATION FOR TOWER WITH EXPANDABLE BASE that was filed on Jan. 31, 2022, the contents of which are incorporated by reference in its entirety.

BACKGROUND

The present disclosure relates to a foundation for a tower. More particularly, the present disclosure relates to a portable, modular foundation that can be stored and transported in a compact, disassembled state and assembled on site where the footprint of the base of the foundation can be expanded or contracted based upon the load requirements of the tower.

The tower supported by the modular foundation can be a monopole or a lattice structure tower, where the tower is capable of supporting equipment including, but not limited to, wind turbines, solar panels, street lights, communication devices, monitoring systems and combinations thereof. Towers, including monopole towers and lattice towers, are becoming increasingly utilized in numerous industries including, but not limited to, communication industries, whether satellite or wireless, and renewable energy industries, whether wind or solar.

The modular foundations provide the necessary structural support to maintain equipment in an elevated position while reducing capital expenditures necessary for a typical support structure required for a monopole or lattice tower. Typically, the towers are secured to concrete foundations having footings that are poured or buried into the ground. Concrete foundations are typically expensive to construct and often require a construction permit. Once constructed, the foundation typically cannot be moved. Therefore, if a location for a tower is abandoned or becomes obsolete, the foundation is either removed and disposed of or abandoned at the location. In the event that the location is abandoned, the foundation can become a potential hazard. Further, if the location of the tower is remote, it can be difficult to get the necessary equipment to the site to pour the concrete foundation.

Additionally, whether a permanent installation or a temporary installation, foundations are designed for particular towers and/or equipment supported by the tower. If a single foundation design and/or footprint is utilized, the foundation is designed for the maximum load for a particular tower height, which can lead to excessive construction costs.

There is a need for a foundation to be able to be arranged to compensate for different sized monopole towers or lattice towers and different equipment supported by the tower.

SUMMARY

One aspect of the present disclosure relates to a foundation for a tower. The foundation includes a plurality of ballast holders spaced from each other and a central portion configured to support a tower. The foundation includes a plurality of connecting members, each connecting member configured to attach a ballast holder to the central portion, wherein a length of the plurality of connecting members is determined based upon the load capacity required to retain the tower in a vertical position, wherein when the plurality of ballast holders is connected to the central portion, the central portion is elevated above the plurality of ballast holders, wherein different lengths of the connecting members expands and contracts the footprint of the foundation to match the foundation to the required maximum loading requirements.

Another aspect of the present disclosure relates to an apparatus configured to retain equipment in an elevated position. The apparatus includes a plurality of ballast holders spaced from each other and a central portion configured to support a tower. The apparatus includes a plurality of connecting members, where each connecting member configured to attach a ballast holder to the central portion. A length of the plurality of connecting members is determined based upon the load capacity required to retain the tower in a substantially vertical position, wherein when the plurality of ballast holders is connected to the central portion, the central portion is elevated above the plurality of ballast holders, wherein different lengths of the connecting members expands and contracts the footprint of the foundation to match the foundation to the required maximum loading requirements. The apparatus includes a tower configured to be attached to and supported by the foundation when in the elevated position.

Another aspect of the present disclosure relates to a method of raising equipment into an elevated position. The method includes determining a weight and elevation of the equipment, determine a size and length of a tower for raising the equipment to the elevation and determining a maximum loading requirement for a foundation based upon the weight and elevation of the equipment and a configuration of the tower. The method further includes determining the number of ballast holders and the weight of ballast to be placed into the number of ballast holders of a foundation and determining a length of a connecting member between each of the ballast holders and a central portion of the foundation. The method further includes assembling the foundation with the number of ballast holders, the central hub and the connecting members, placing the ballast on the ballast holders, and raising and securing the tower to the central hub.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise.

DETAILED DESCRIPTION

The present disclosure relates to a foundation for a tower, whether a monopole tower or a lattice tower, that is configured to adjust a footprint or base of the foundation to meet design specifications for towers of different heights and/or different equipment supported by the towers to withstand maximum loads on the towers and equipment. The foundation includes a plurality of ballast holders that are attached a selected distance from a central hub by connecting members, where the tower is connected to the central hub in the case of the monopole and to the connecting members in the case of the lattice tower. The foundation uses the same or similar central hub and ballast holders while the length of the connecting members, typically metal beams, is varied to provide the required footprint for the foundation to withstand the loads on a particular tower. As such, the same ballast holder and central hub can be utilized for a number of different sized towers and/or applications.

The foundation is modular such that it can be transported disassembled in a crate that can be transported by a vehicle such as a truck or can be airlifted to a site and then assembled using common tools. Additionally, ballast can be provided for placement into the ballast holders that can also be transported by a truck along with the tower and foundation.

Figure 1:
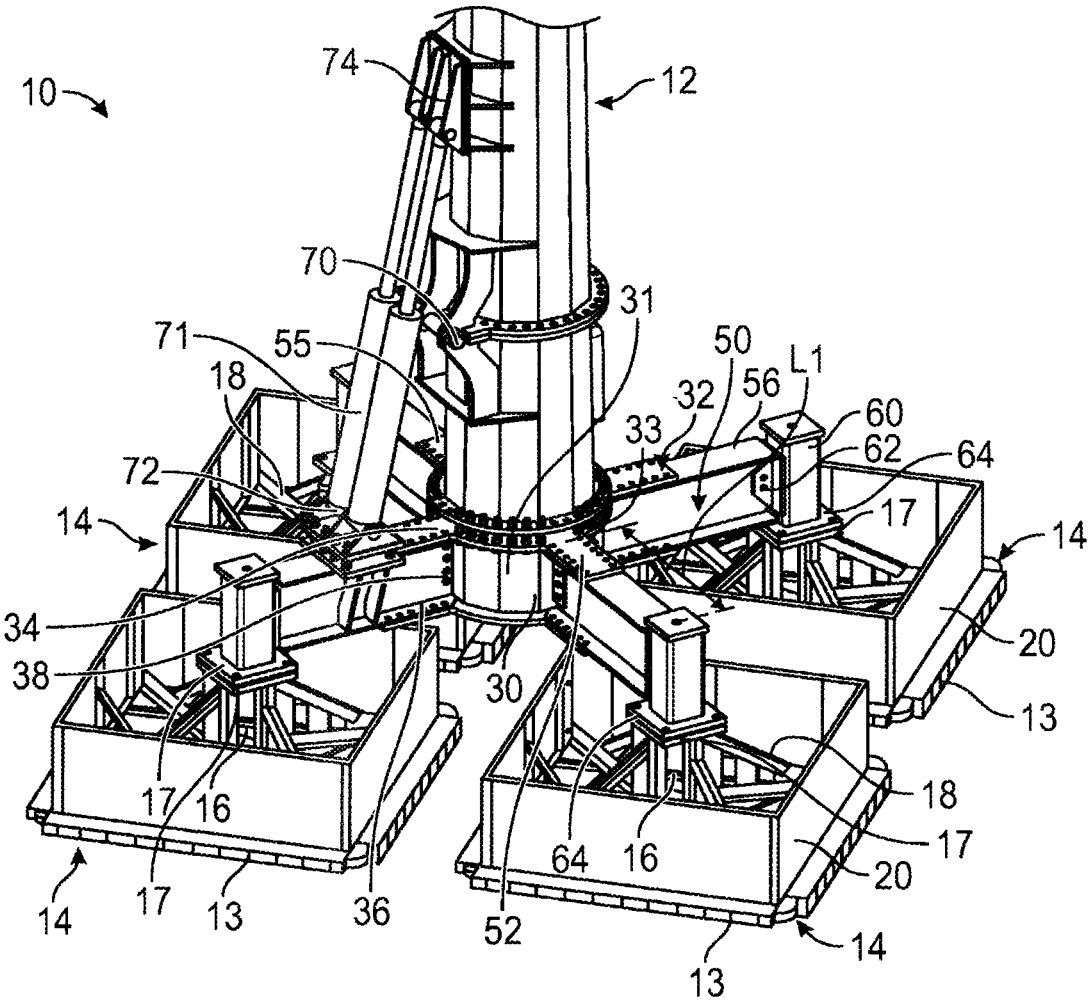
FIG. 1 is a perspective view of an exemplary embodiment of a foundation with a plurality of ballast holders connected to a central hub and supporting a raised tower with connecting members having a first length.
Figure 2:
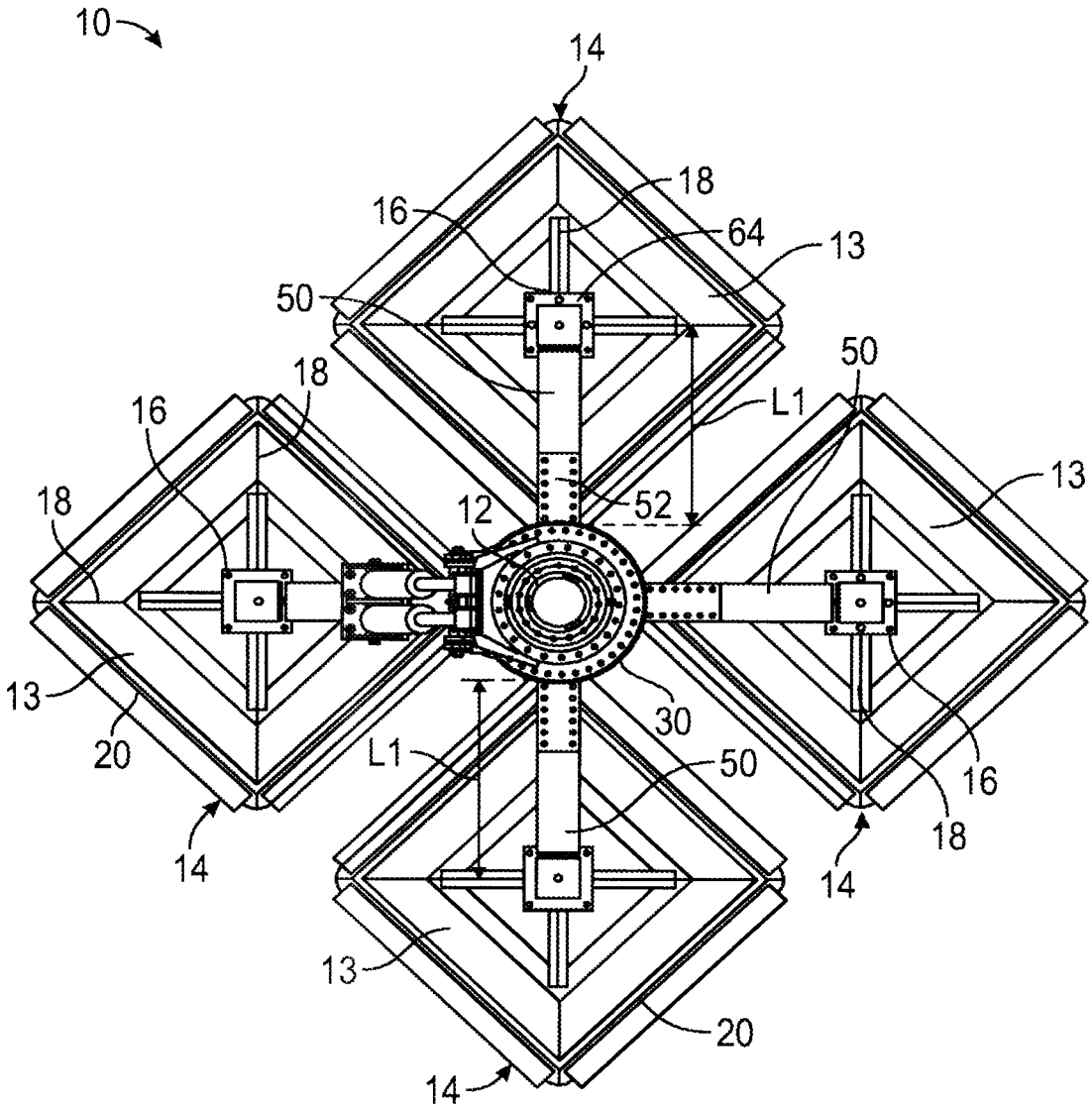
FIG. 2 is a top view of the foundation of FIG. 1 with the raised tower.

Referring to FIGS. 1 and 2, the present disclosure relates to a modular foundation 10 for supporting a monopole 12 or a lattice tower. The foundation 10 includes a plurality of ballast holders 14 that are attached to a central hub 30 with a plurality of connecting members 50. The plurality of connecting members 50 are substantially uniformly positioned about the central hub 30 such that the plurality of ballast holders 14 are substantially uniformly spaced about the central hub 30. By locating the ballast holders 14 at substantially uniform locations about the central hub 30, foundation 10 can withstand substantially the same forces on the tower from any wind direction, making the foundation 10 omnidirectional. By way of non-limiting example, the disclosed foundation 10 includes four spaced apart ballast holder 14. However, the foundation 10 can include three or more uniformly spaced apart ballast holders 14 and maintain a substantially omnidirectional resistance to forces.

The ballast holders 14 includes a connecting hub 16 that is substantially centrally located. The connecting hub 15 is secured to a floor 13 with a plurality of brace arms 18. The connecting hub 15 includes a mounting plate 17 have a plurality of spaced apart apertures that are configured to attach to the connecting members 50. The plurality of brace arm 18 attached the floor to the connecting hub 16 and also aid in providing structural integrity or strength to the ballast holder 14. In some embodiments, the ballast holders 12 include a wall 20 that is positioned about the perimeter of the floor 14 where the brace arms 18 also provide support to the wall 20.

Whether the wall 20 is needed is determined based upon the type of ballast being used. By way of non-limiting example, if the ballast is precast concrete structures that are placed on the floor 15 of the ballast holder or preformed blocks that are stackable on the floor 15 to provide the necessary ballast, then the wall 20 is not necessary. However, if the ballast utilized in the ballast holder 14 is native soil or native rock, then the wall 20 would be utilized to retain the ballast within the ballast holder.

The foundation 10 includes a central hub 30 that includes a plurality of substantially uniformly spaced apart mounting brackets 32 that are welded or bolted to a side surface 31 of the central hub 30. Each mounting bracket 32 includes an upper portion 34 and a lower portion 36, both with a plurality of apertures therein. The upper portion 34 and lower portion 36 are connected by a substantially vertical middle portion 38 having a slot therein and a plurality of aligned apertures.

A first end 52 of a connecting member 50, typically an I beam, is positioned within the mounting bracket 32. The first end 52 of the connecting member 50 has apertures that align with apertures in the mounting bracket 32 such that the first end 52 is secured to the upper portion 34, the lower portion 36 and the substantially vertical middle portion 38 with bolts and nuts.

Once the first end 52 of the connecting member 50 is secured to the central hub 30, an end support 60 is secured to a second end 56 of the connecting member 50 with bolts positioned through apertures in the second end 56 of the connecting member 50 and a mounting bracket 62 extending from the end support 60, where a height of the end support 60 at least spans a height of the connecting member 50.

The end support 60 includes a heel 64 having apertures that align with apertures in mounting plate 17 of the connecting hub 16. Threaded bolts and a plurality of nuts are positioned through the apertures in the mounting plate 17 and the heel 64 such that the heel 64 can abut the mounting plate or can be raised a distance from the mounting plate 17 to level the foundation 10. The same process is used to attach each connecting member 50 to the central hub 30 and each connecting but 16 of each ballast holder 14.

As illustrated, the foundation 10 includes four separate ballast holders 16 and four connecting members 50. However, the foundation can include three or more substantially uniformly spaced apart ballast holders 16 and the same number connecting members 50.

Once the central hub 30 is connected to the ballast holders 16 with the connecting members 50, the tower 12 can be raised using a hinge 70 between the tower 12 and the central hub 30 and a lifting mechanism 71, such a hydraulic system or a jack system, attached at one end to lifting bracket 72 on one connecting member 50 and another bracket 74 on the tower 12. Once raised, a plurality of bolts are positioned through apertures in a rim 33 about the central hub 30 and an exterior plate 13 on the tower 12 to secure the tower 12 in an upright position and to optionally place the tower 12 in a substantially vertical position.

The foundation 10 of the present disclosure allows for the same central hub 30 and ballast holders 12 to be utilized for numerous sizes and types of towers, while changing a length of the connecting member 30 to change the footprint of the foundation 10 and therefore the load capacity of the foundation 10. Referring to FIGS. 1 and 2, the foundation 10 includes connecting members 50 having a length L1 where the ballast holders 14 are relatively close together and also proximate the central hub 30. In the configuration illustrated in FIGS. 1 and 2, the foundation 10 can withstand a first loading.

Figure 3:
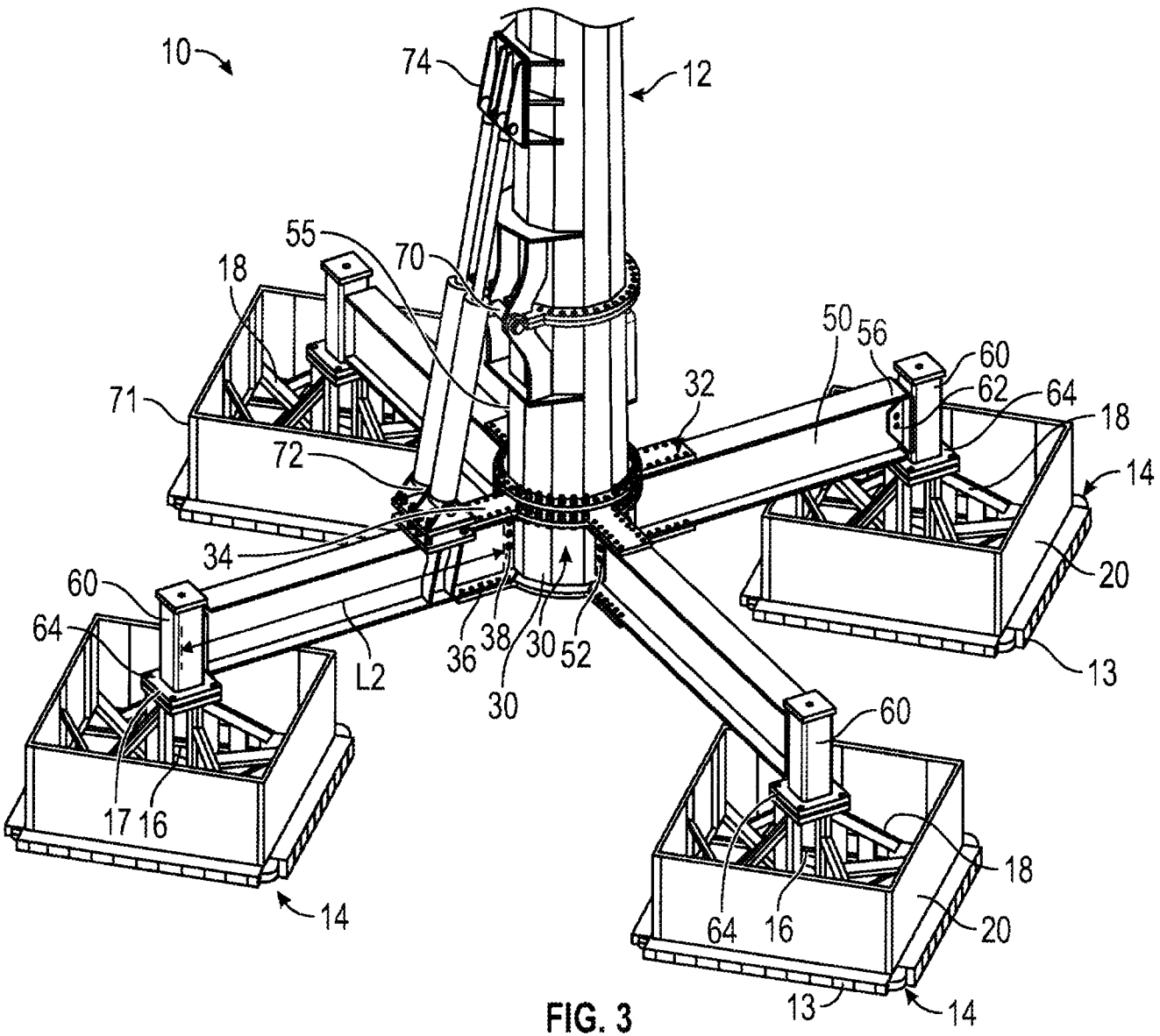
FIG. 3 is a perspective view of an exemplary embodiment of a foundation with a plurality of ballast holders connected to a central hub and supporting a raised tower with connecting members having a second length that is longer than the first length illustrated in FIG. 1.
Figure 4:
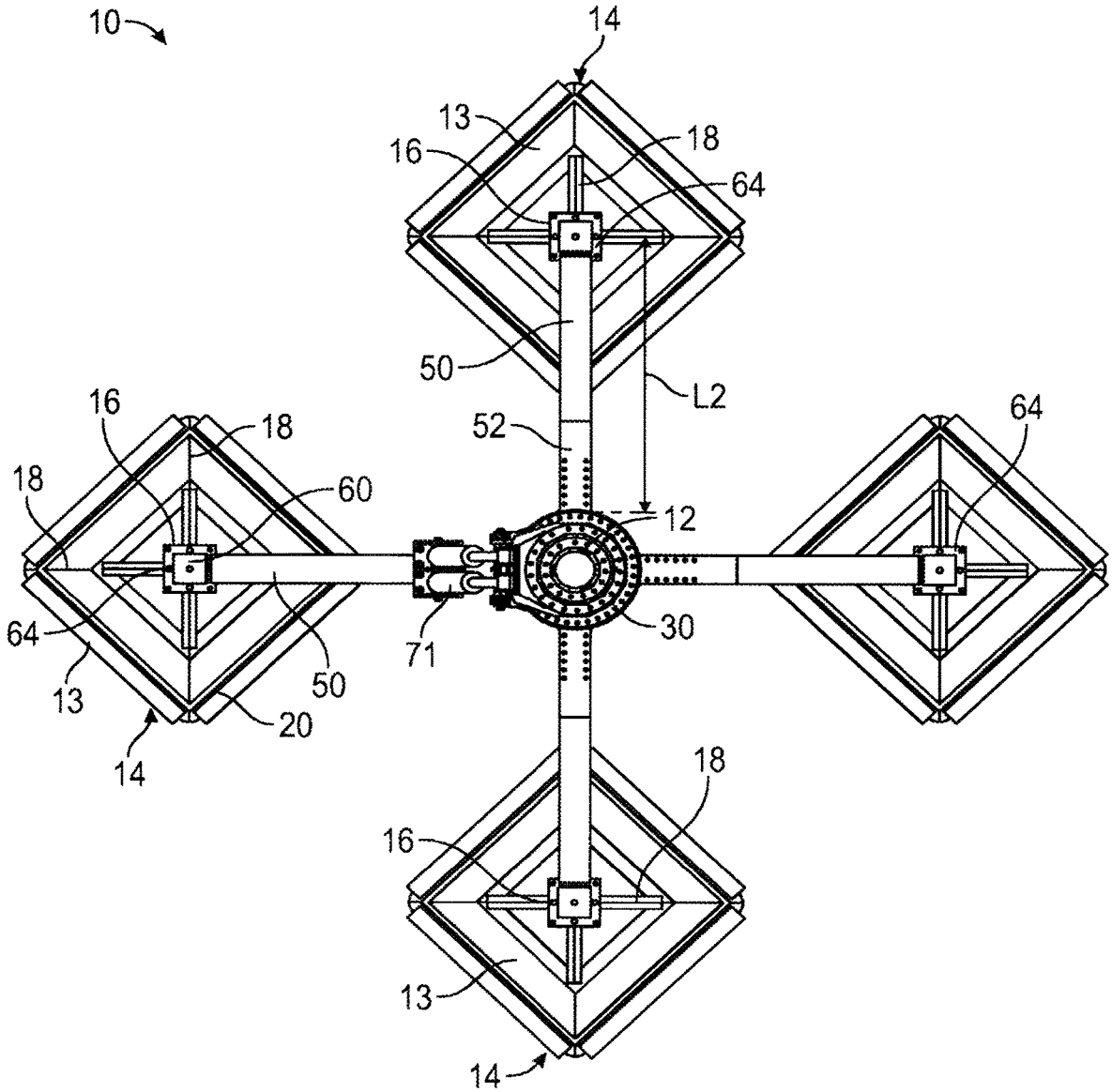
FIG. 4 is a top view of the foundation of FIG. 3 with the raised tower.

Referring to FIGS. 3 and 4, the same ballast holders 14 and central hub 30 are utilized. However, the connecting members 30 are a length L2 that is longer than the length of the connecting members 30 illustrated in FIGS. 1 and 2, and having length L1. As such, the foundation 10 using the connecting members 30 having the length L2 can withstand higher loads than the foundation using he connecting members L1.

Figure 5:
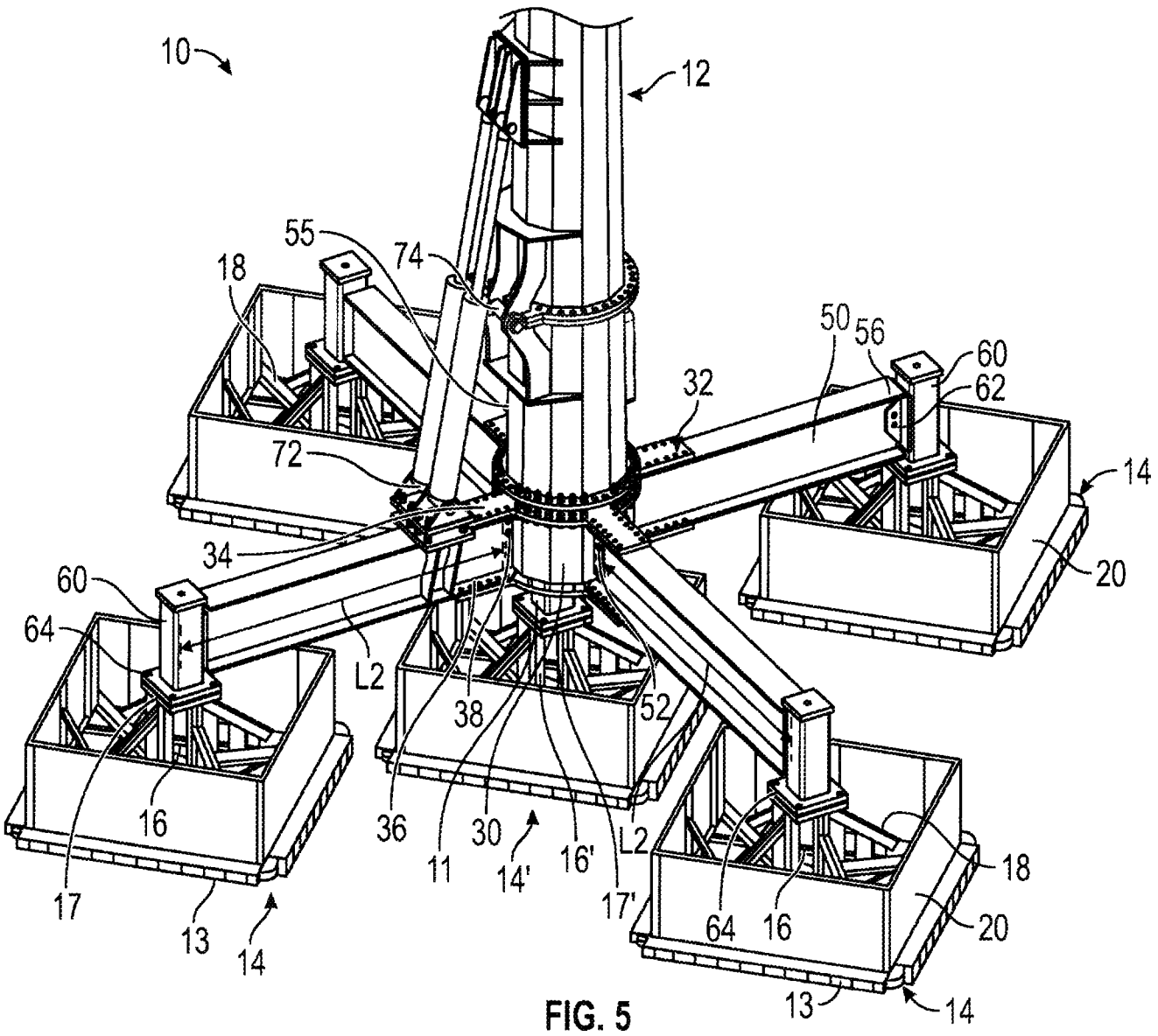
FIG. 5 is a perspective view of the foundation of FIG. 3 with a ballast holder attached to the connecting member of the foundation.

Referring to FIG. 5, the same foundation 10 illustrated in FIGS. 3 and 4 can increase the loading capacity by utilizing a ballast holder 14' attached to the central hub 30. The ballast holder 14' can have the same configuration as the ballast holders 14 and can be utilized when the ballast holders 14 are sufficiently spaced apart to provide the necessary area for the ballast holder 14'. However, a spacer 11 is attached to the central hub 30 proximate a bottom end and also to the mounting plate 17' on the connecting hub 16'.

By way of example and utilizing the foundation 10 with the connecting members having the length L1, as illustrated in FIGS. 1 and 2, when four ballast holders are substantially adjacent, the foundation can support a nominal sixty-foot tower 12. When the same foundation using the same holders 14 are spaced five feet apart by using a connecting member 30 of the length L2, the same foundation 10 can support an eighty-foot tower 12. Yet still, when the same four ballast holders 14 are spaced about ten feet apart using the connecting members 30 with the length L2, the same foundation 10 can support a one-hundred-foot tower 12.

By spacing the ballast holders 14 from each other and/or utilizing the ballast holder 14', the loading capacity of the foundation 10 can be widely varied to meet design specification. As such, the foundation 10 components and ballast requirements can be determined based upon loading requirements. As such, the foundation 10 can be customized to meet loading requirements which reduces shipping cost, shipping size and/or weight.

For instance, if the tower is to be x feet tall and carry a load of 7, then the loading capacity of the foundation can be predetermined and the connecting member 50 of a length that exceeds the loading capacity can be provided with the foundation 10 while retaining the same central portion 30 and ballast holders 14. By way of example, a AFS 350 foundation manufactured by ARE Telecom Incorporated headquartered in St. Paul, MN has about a 40 kip-ft capacity. When four AFS 350 ballast holders 14 are placed proximate each other (FIGS. 1 and 2) and are connected to the central hub 30, the capacity increases to 230 kip-ft. When the distance between the ballast holders 14 is increased to five feet (FIGS. 3 and 4), the capacity increases to a 360 kip-ft and when yet increased to ten feet (FIGS. 3 and 4), the capacity increases to 440 kip-ft. As such the same foundation 10 with different length connecting members 30 can be utilized to support towers 12, whether monopoles or lattice towers, ranging up to 130 feet.

To assemble the foundation 10 and raise the tower 12, whether a monopole tower or a lattice tower, the unassembled foundation is typically in a crate that is taken to a site by vehicle or by air and dropped on site. The foundation 10 can be typically stored in a 4'×4'×3' crate.

In some embodiments, the disassembled tower 12 can also be placed on the truck and optionally ballast can also be placed on the truck. Once to the site, the ballast holders 14 are assembled and then the connecting members 50 are secured to the ballast holders 14 and the central hub 30. Once assembled, the central hub 30 can be leveled by raising and/or lowering the heel 64 relative to connecting plate 17.

Ballast is then place on the floor 13 of the ballast holder 14, such as concrete slabs or steel plates that are carried on the vehicle and are placed on the floor 15 between the bracing 18. In the disclosed ballast holder 14, the concrete slabs or steel plates are wedge shaped to fit between the bracing 18. In some embodiments, the concrete slabs or steel plates include structures that can be engaged by a loader or forklift to manipulate the slabs or plates on the ballast holder 14 or take the slabs or plates back to the vehicle when the tower 12 and foundation 10 are used for a temporary purpose.

In other embodiments, the walls 20 are constructed to provide an interior volume for ballast. The ballast can be local to the site and can include dirt and rocks or other ballast. Alternatively, ballast such as bricks can be transported to the site to provide the desired amount of ballast.

Figure 6:
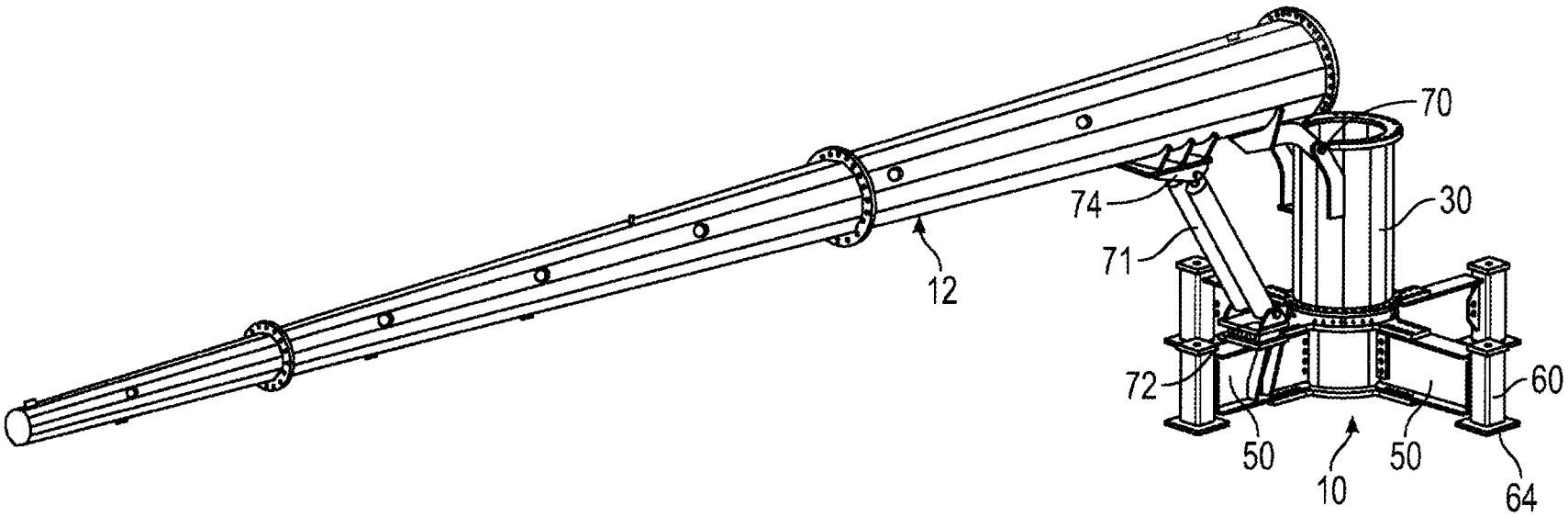
FIG. 6 is view of the tower in a lowered position relative to the foundation.
Figure 7:
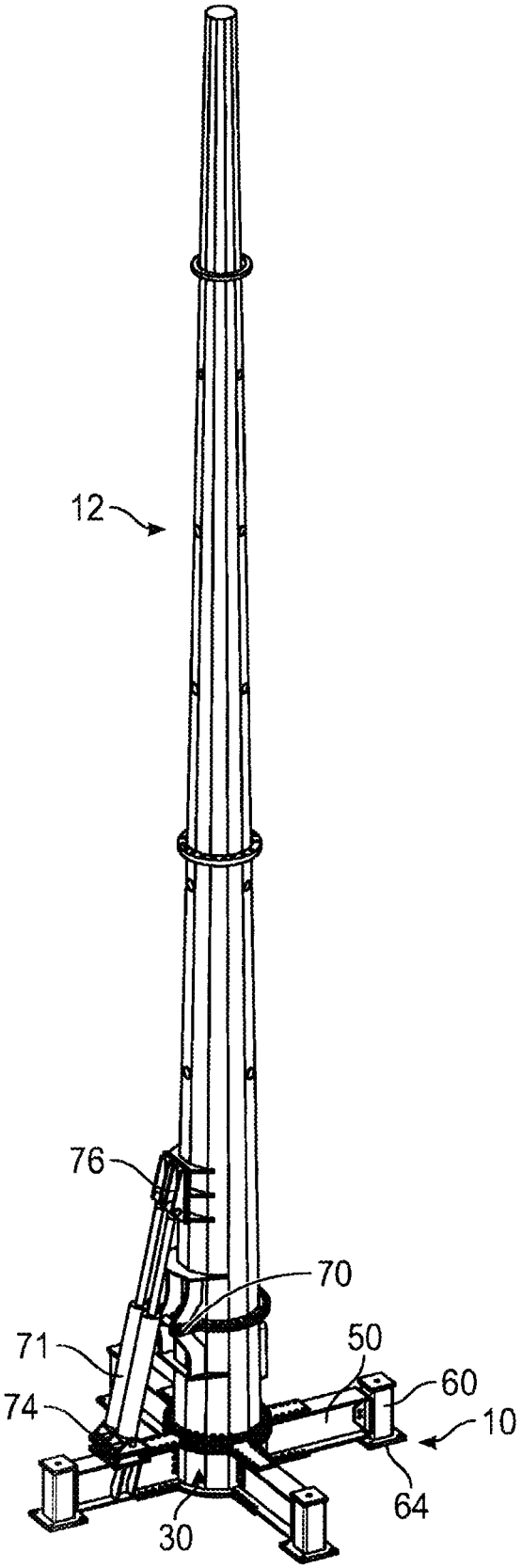
FIG. 7 is a view of the tower in a raised position relative to the foundation.

Once the foundation 10 is assembled and the ballast is loaded onto the ballast holders 14, the pole 12 is raised from a non-elevated position as illustrated in FIG. 6 to an elevated position as illustrated in FIG. 7. Once in the elevated position, the plurality of bolts are positioned through apertures in a rim 32 about the central hub 30 and an exterior plate 13 on the tower 12 to secure the tower 12 in an upright position and to optionally place the tower 12 in a substantially vertical position.

The modular nature of the foundation and the ability to bring selected ballast or use native ballast allows towers to be raised in significantly less time than currently capable. By way of example a tower can now be raised and brought into use within a single work day instead of multiple work days because of the disclosed foundation 10.

Although the present disclosure has been described with reference to preferred embodiments, workers skilled in the art will recognize that changes may be made in form and detail without departing from the spirit and scope of the invention. In addition, any feature disclosed with respect to one embodiment may be incorporated in another embodiment, and vice-versa.

The invention claimed is:

1. A foundation for a tower comprising:

a plurality of ballast holders spaced from each other;

a central portion configured to support a tower; and a plurality of connecting members, each connecting member configured to attach a ballast holder to the central portion, wherein a length of the plurality of connecting members is determined based upon a load capacity required to retain the tower in a substantially vertical position, wherein when the plurality of ballast holders is connected to the central portion, the central portion is elevated above the plurality of ballast holders, wherein different lengths of the connecting members expands and contracts a footprint of the foundation to match the foundation to a required maximum loading requirements.

2. The foundation of claim 1, wherein each of the plurality of ballast holders comprises:

a substantially centrally located connecting hub;

a floor extending from the connecting hub; and a bracing structure configured to retain the connecting hub to the floor, wherein the floor is configured to retain ballast thereon.

3. The foundation of claim 2, wherein each of the plurality of ballast holders further comprises:

a wall positioned about a perimeter of the floor wherein the bracing is configured to retain the wall in a substantially vertical position such that soil and are rocks can be utilized as ballast.

4. The foundation of claim 2 and further comprising preformed ballast configured to be placed on the floor of the ballast holders.

5. The foundation of claim 4, wherein the preformed ballast comprises preformed concrete or steel plate.

6. The foundation of claim 1, wherein the central portion comprises:

a plurality of substantially uniformly spaced mounting brackets attached to a side surface the central portion, wherein each of the plurality of substantially uniformly spaced mounting brackets is configured to accept a proximal end of one of the plurality of connecting members.

7. The foundation of claim 1, wherein the central portion further comprises:

a rim proximate a top end of the central portion wherein the rim is configured to engage a bottom end of the tower and retain the bottom end of the tower to the central portion when the tower is in an elevated position.

8. The foundation of claim 1, wherein the each of the plurality of connecting members comprises an I-beam.

9. The foundation of claim 8, each of the plurality of connecting members comprises an end support proximate a distal end, wherein the end support comprises a heel configured to engage a substantially centrally located hub in each of the plurality of ballast holders.

10. The foundation of claim 1 and further comprising a central ballast holder configured to be attached to the central hub wherein the central ballast holder is configured to accept ballast and increases the maximum loading capacity of the foundation.

11. An apparatus configured to retain equipment in an elevated position, the apparatus comprising:

a plurality of ballast holders spaced from each other;

a central portion configured to support a tower;

a plurality of connecting members, each connecting member configured to attach a ballast holder to the central portion, wherein a length of the plurality of connecting members is determined based upon a load capacity required to retain the tower in a substantially vertical position, wherein when the plurality of ballast holders is connected to the central portion, the central portion is elevated above the plurality of ballast holders, wherein different lengths of the connecting members expands and contracts a footprint of the foundation to match the foundation to a required maximum loading requirements; and a tower configured to be attached to and supported by the foundation when in the elevated position.

12. The apparatus of claim 11, wherein the tower comprises a monopole tower configured to be hingedly attached to the central portion and raised with a lifting mechanism attached to the foundation and the monopole tower.

13. The apparatus of claim 11, wherein the tower comprises a lattice tower wherein the lattice tower configured to be mounted to the plurality of mounting members as the lattice tower is constructed.

14. The apparatus of claim 11, wherein each of the plurality of ballast holders comprises:

a substantially centrally located connecting hub;

a floor extending from the connecting hub; and a bracing structure configured to retain the connecting hub to the floor, wherein the floor is configured to retain ballast thereon.

15. The apparatus of claim 14, wherein each of the plurality of ballast holders further comprises:

a wall positioned about a perimeter of the floor wherein the bracing is configured to retain the wall in a substantially vertical position such that soil and are rocks can be utilized as ballast.

16. The apparatus of claim 11, wherein the central portion comprises:

a plurality of substantially uniformly spaced mounting brackets attached to a side surface the central portion, wherein each of the plurality of substantially uniformly spaced mounting brackets is configured to accept a proximal end of one of the plurality of connecting members.

17. The apparatus of claim 11, wherein the central portion further comprises:

a rim proximate a top end of the central portion wherein the rim is configured to engage a bottom end of the tower and retain the bottom end of the tower to the central portion when the tower is in an elevated position.

18. The apparatus of claim 11, wherein the each of the plurality of connecting members comprises an I-beam.

19. The apparatus of claim 18, each of the plurality of connecting members comprises an end support proximate a distal end, wherein the end support comprises a heel configured to engage a substantially centrally located hub in each of the plurality of ballast holders.

20. A method of raising equipment into an elevated position, the method comprising:

determining a weight and elevation of the equipment;

determining a size and length of a tower for raising the equipment to the elevation determining a maximum loading requirement for a foundation based upon the weight and elevation of the equipment and a configuration of the tower;

determining a number of ballast holders and a weight of ballast to be placed into the number of ballast holders of a foundation;

determining a length of a connecting member between each of the ballast holders and a central portion of the foundation;

assembling the foundation with the number of ballast holders, the central portion and the connecting members;

placing the ballast on the ballast holders; and raising and securing the tower to the central hub.

* * * * *